US005660420A

United States Patent [19]

Smith et al.

[11] Patent Number: 5,660,420

[45] Date of Patent: Aug. 26, 1997

[54] ESPAGNOLETTE WINDOW LOCKING SYSTEM AND BOLT CONSTRUCTION

[75] Inventors: John Colin Smith, Letchworth; Patrick Ernest Christmas, Langford, both of United Kingdom

[73] Assignee: Schlegel (U.K.) Holdings Limited, Coalville, United Kingdom

[21] Appl. No.: 179,503

[22] Filed: Jan. 10, 1994

[30] Foreign Application Priority Data

Jan. 11, 1993 [GB] United Kingdom ..... 9300402

[51] Int. Cl.[6] ..... E05C 7/00

[52] U.S. Cl. ..... 292/3; 292/39; 292/336.3; 292/DIG. 53; 292/DIG. 60; 403/397; 24/576; 70/120; 70/451

[58] Field of Search ..... 70/89, 90, 107, 70/120, DIG. 26, DIG. 34, DIG. 63, 447, 448, 451, 452; 292/DIG. 38, DIG. 47, DIG. 49, DIG. 51, DIG. 53, DIG. 54, DIG. 57, DIG. 60, 3, 336.3, 34, 36, 37, 39; 24/30.5 P, 575–577; 403/397

[56] References Cited

U.S. PATENT DOCUMENTS

| | | | |
|---|---|---|---|
| 2,886,960 | 5/1959 | Willett et al. | 70/120 X |
| 2,914,936 | 12/1959 | Reinold | 24/576 X |
| 3,068,939 | 12/1962 | Commisso | 24/576 X |
| 4,368,905 | 1/1983 | Hirschbein | 292/39 X |
| 4,420,905 | 12/1983 | Kucharczyk | 292/DIG. 49 X |
| 4,617,775 | 10/1986 | Padrun | 403/397 X |
| 4,688,961 | 8/1987 | Shioda et al. | 24/575 X |
| 4,733,988 | 3/1988 | Kelly | 403/397 X |
| 4,773,682 | 9/1988 | Saelzer | 292/DIG. 53 X |
| 4,848,811 | 7/1989 | Laufenburg et al. | 292/DIG. 53 X |
| 4,907,908 | 3/1990 | Gerhard | 403/393 |
| 4,932,696 | 6/1990 | White | 292/336.3 |
| 5,042,852 | 8/1991 | Vitt et al. | 292/DIG. 53 X |
| 5,074,133 | 12/1991 | Simoncelli | 70/90 |
| 5,102,174 | 4/1992 | Prevot | 292/336.3 |
| 5,118,143 | 6/1992 | Gerard | 292/39 |
| 5,183,302 | 2/1993 | Pelachyk et al. | 292/DIG. 38 X |
| 5,371,991 | 12/1994 | Bechtel et al. | 403/397 X |

FOREIGN PATENT DOCUMENTS

| | | | |
|---|---|---|---|
| 2457365 | 1/1981 | France | 70/120 |
| 2600127 | 6/1986 | France . | |
| 1908479 | 9/1970 | Germany | 292/DIG. 47 |
| 2040632 | 2/1972 | Germany | 292/DIG. 57 |
| 2429893 | 1/1976 | Germany | 292/DIG. 57 |
| 2720862 | 11/1978 | Germany | 70/448 |
| 2311990 | 9/1994 | Germany . | |
| 2228764 | 9/1990 | United Kingdom | 70/120 |

*Primary Examiner*—Suzanne Dino
*Attorney, Agent, or Firm*—Cumpston & Shaw

[57] ABSTRACT

A bolt construction for use in an espagnolette locking system for the multi-point locking of sashes is made up of a linking rod (16) and a locking pin (17), one or the other of which is of fixed length and the other of which may be any one of a plurality of different lengths, the rod and pin being adapted to be connected together with a snap fit in any one of a plurality of different positions, thereby allowing the length of the interconnecting rod and pin to be chosen to fit a particular size of sash. The construction also provides a bolt construction for use in an espagnolette locking system for multi-point locking of sashes, which bolt construction is formed for assembly within a rebate in a face of the sash by means of a snap fit within the rebate. The construction also extends to a sash fitted with two such bolt constructions.

14 Claims, 3 Drawing Sheets

ESPAGNOLETTE WINDOW LOCKING SYSTEM AND BOLT CONSTRUCTION

The present invention relates to window locking systems, more particularly to those systems known as espagnolette drive systems which provide for the multi-point locking of windows via the transmission of a single actuating force, such as a rotary force applied to a central drive gear, to various points along a door or a window sash, hereinafter referred to as a sash.

Typically such systems require adjustment of their interacting components prior to assembly and installation, due to the predetermined relationship between the complementary engaging members at the various locking points on the window sash and frame respectively. Typically there is a central latch between,two shoot-bolt arrangements at the opposite edges of the window sash. Assembly can thus be costly and time consuming, since pieces often have to be cut to length.

Thus, one object of the present invention is to provide a convenient means of adjusting the length of the shoot bolts of such a multi-point locking system to fit any dimension of sash located within a frame, without the need for such cutting.

A further object of the present invention is to provide a means of rapidly and conveniently installing the espagnolette drive rod or bolt construction into a window sash.

According to one aspect of the present invention, we provide a bolt construction for use in an espagnolette locking system for the multi-point locking of sashes, the bolt construction being axially adjustable so as to permit its installation in window sashes of different dimensions, said bolt construction comprising a linking rod and a locking pin adapted to be connected together with a snap fit in any one of a plurality of different positions, thereby allowing the length of the interconnected rod and locking pin to be chosen to fit a particular size of The bolt construction is adapted for use with and connectable to a drive gear adapted to be located in a central region of the sash, said drive rod and locking pin being adapted to snap fit together in any one of a plurality of relative positions, thereby allow the length of the interconnected rod and locking pin to be chosen to fit a particular size of sash. Normally, two such bolt constructions would be used with one drive gear.

The drive rod may be of a fixed standard length, enabling an appropriate length of window locking pin to be selected for connection thereto according to the dimensions of said sash.

In an alternative embodiment, the locking pin is of a fixed standard length, and the drive rod is of a length selected according to the dimensions of said sash.

Preferably, in either embodiment, said window locking pin is adapted to be located with a force fit within a roughened portion on said linking rod. The roughened portion may be provided by knurling, circumferential ribs, a screw thread, or the like. The linking rod is connected to a drive member of an espagnolette drive gear in known or other manner, so that it can be operated as any other espagnolette mechanism.

The espagnolette bolt constructions described above can be used with a standard handle operated espagnolette drive gear, which is associated with a roller cam, so as to provide axially movable locking pins, bolt constructions, terminating in variable length so as to render the complete espagnolette drive mechanism incorporatable into a sash 0f any dimension.

The present invention further provides an espagnolette bolt construction adapted to be installed in a sash by snap fitting, the bolt construction being designed for snap-in engagement within a rebate formed in the face of the door or window sash.

Preferably, the bolt construction incorporates an axial linking rod extending between a drive gear and a looking pin, the linking rod having on each side face thereof a projection so that the rod can snap into a complementary rebate provided along the exposed edge of said door or sash. The projection may be defined by grooves in tapered side faces of the rod which are engaged with projecting ribs provided on each side of the rebate.

The groove in the linking rod to receive the locking pin may be oriented with respect to said window sash rebate such that the open face,of the groove is outermost. In such a case, the open face would preferably be covered by means of a separate planar coverstrip, which may be clipped into additional grooves provided in said sash rebate, such that a flat face is visible. Preferably, however, the said groove faces inwardly and a separate overlapping cover strip is provided to extend over the sash rebate between an end portion of the linking rod and a corner of the door or sash frame to overlie any exposed portion of the locking pin. This cover strip may also form a snap-fit within the rebate.

On its edge(s) accommodating the espagnolette mechanism, the sash is preferably provided at each corner with a corner piece, against which said cover strip abuts and within which is provided a circular guide for the alignment of said looking pin during motion thereof as a result of the locking operation. The corner piece may be mounted on said sash by screw fittings or, preferably, via a snap-fit connection.

From the foregoing it can be seen that the present invention provides for the rapid, convenient installation of a bolt for an espagnolette drive mechanism by snapping together the component parts as described above.

A preferred embodiment of the invention is now described by way of example with reference to the accompanying drawings, in which.

Figure 2:
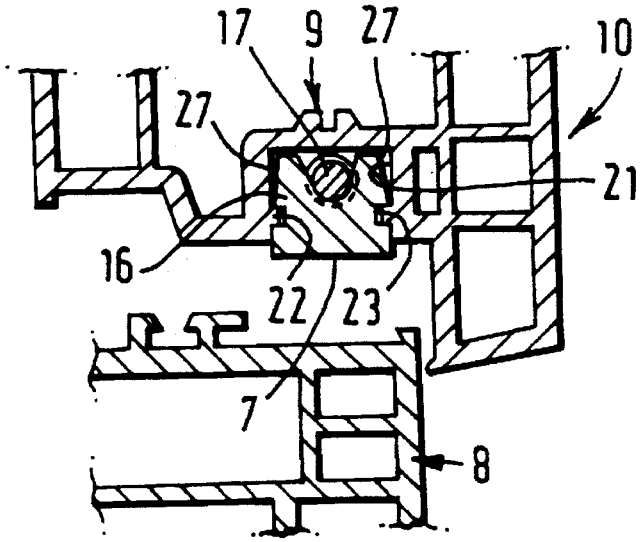
FIG. 2 is a transverse section along the line 2—2 of FIG. 1, through both the window sash and its frame.

Referring to FIG. 2, a window frame is shows at 8 and a window sash at 10. The sash 10 has the usual rebate 21, sometimes known as a Euro-groove, into which a linking rod portion 16 of a drive rod foe an espagnolette looking mechanism is located. Traditionally, in known constructions (not shown) the drive rod has been formed with a plurality of longitudinally extending diametral slots through which fixing screws pass, the screws engaging in holes formed in an enlarged area 9 of the base of the rebate 21, with the heads of the screws holding a plurality of retaining plates against the cheeks of the rebate 21, and thus holding the drive rod in the rebate 21. Due to the slots in the rod, it can, however, slide to and fro in the rebate. Such a construction is, however, time consuming to assemble.

Figure 1:
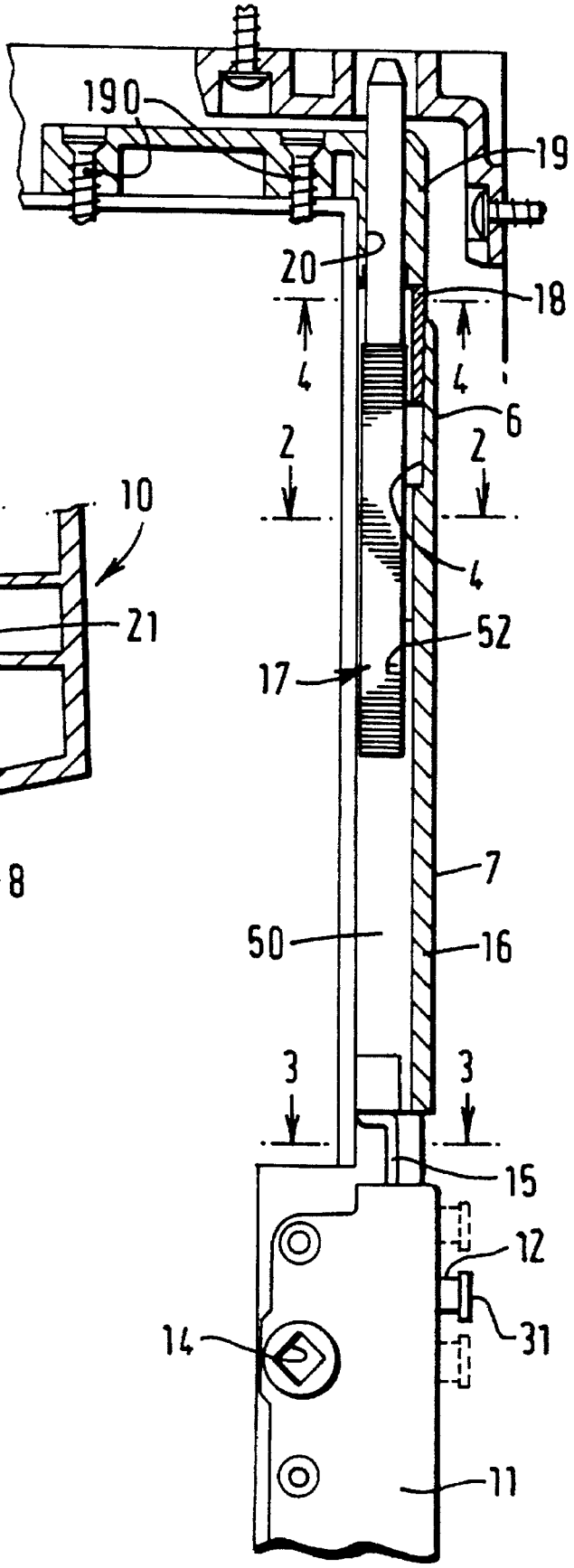
FIG. 1 is a longitudinal section through one end of a window sash incorporating part of an espagnolette mechanism and shows the mechanism at the mid point of lock travel with a locking bolt shown in mid adjustment, part of the sash being omitted for the sake of clarity.
Figure 3:
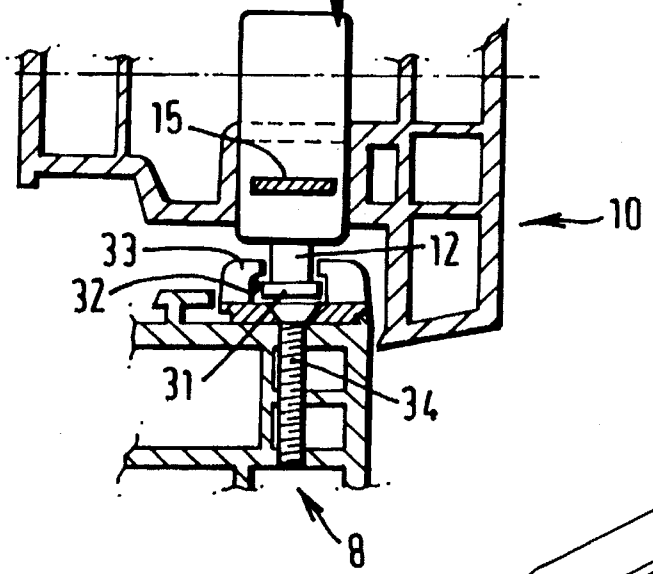
FIG. 3 is a transverse section along the line 3—3 of FIG. 1.

Referring now to FIGS. 1 and 3 of the drawings, there is shown a drive gear housing 11 supporting an associated roller cam 12. As can be seen from FIG. 3, the drive gear housing 11 is mounted in the sash 10 to project through the base of the rebate 21. The roller cam 12 has a mushroom head 31 which fits into a cavity 32 formed in a keep member 33 which is attached by one or more screws 34 to the window frame 8. The cam 12 is operable via a handle (not shown) which drives a spindle 14. The spindle drives a gear pinion (not shown) which is connected to an axial drive device 15. As so far described, the mechanism is of known construction.

The axial drive device 15 is connected in known or other manner to a generally channel-shaped axial linking rod 16. In accordance with this invention, the rod 16 forms a snap-fit into the sash rebate or Euro-groove 21.

Figure 5:
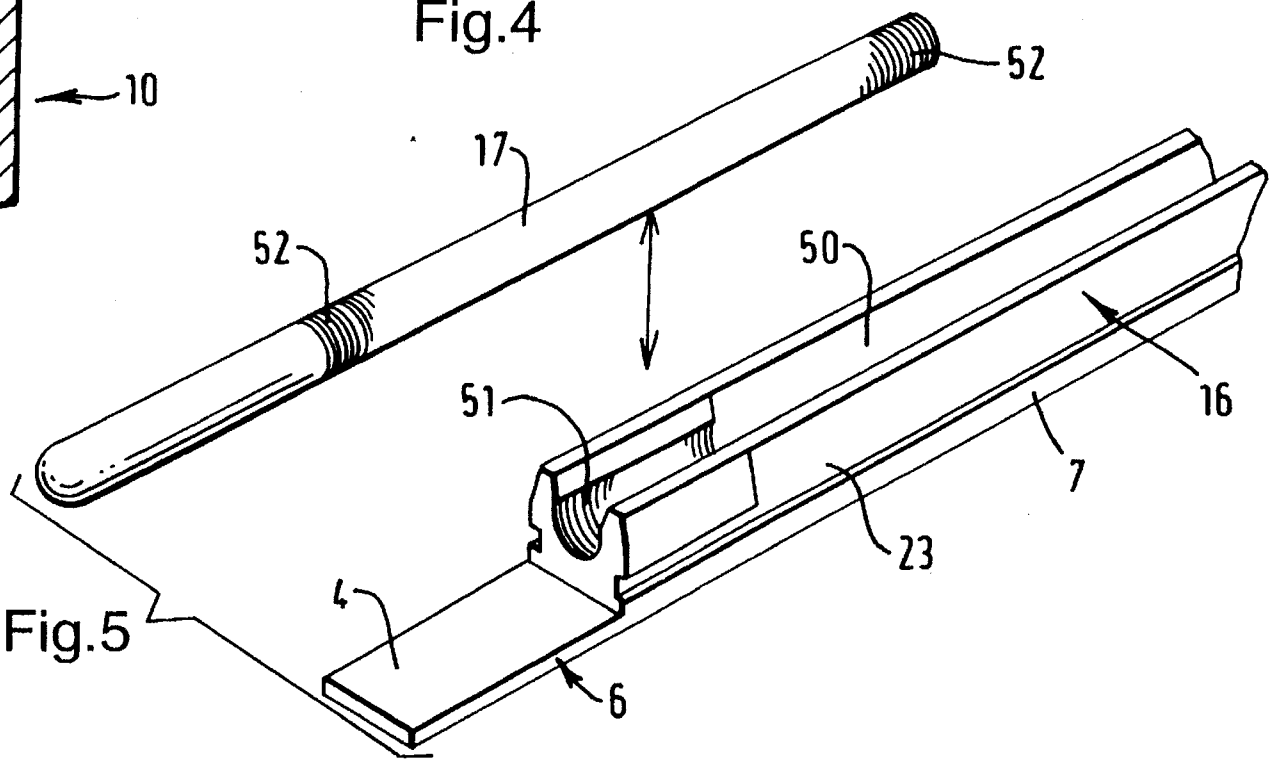
FIG. 5 is an exploded, partial perspective view, to an enlarged scale, of a bolt construction formed of a linking rod showing its internal relationship with a window locking pin.

As is best seen in FIGS. 1, 2 and 5, the axial linking rod 16 is of generally rectangular cross-section, but each of its sides has a taper 27 so as to diverge towards a top wall. Where the tapers 27 begin on each side wall, recesses 23 are provided, extending along the full length of the rod 16. These recesses 23 co-operate with longitudinally extending ribs 22 which are formed in known manner on the inner faces of the rebate 21. To assemble rod 16 in the sash, it is pushed into the rebate 21, until the ribs 22 snap into the recesses 23 running along the length of linking rod 16 and located at the junction of the double tapers.

Also in accordance with this invention, the linking rod 16 has a circular groove 50 formed throughout its length in the top wall to receive a locking pin 17 of co-operating circular cross-section. The majority of the surface of the pin 17 is knurled, ribbed, threaded or otherwise roughened as shown at 52, and the end portion of groove 50 remote from the end connected to the drive device 15 is likewise knurled, ribbed, threaded or otherwise roughened as at 51 for frictional engagement with the pin 17 when it is snapped into the groove 50. This arrangement allows the combined length of rod 16 and locking pin 17 to be adjusted at will to suit the dimension of the sash to which it is to be fitted. If the pin 17, and preferably the groove 50 as well, are threaded, fine length adjustment can be obtained by twisting the pin 17 about its longitudinal axis. It will also be appreciated that the linking rod 16 could alternatively be twisted about its longitudinal axis to achieve fine length adjustment, provided the appropriate screw thread was provided.

As is best seen in FIG. 2, the base 7 of the linking rod 16 completely fills the mouth of rebate 21, thus presenting a neat appearance. The rod 16 has a projecting tail 6 at its end remote from drive device 15 which assists this function, and which has a rebate 4 on its internal face to accommodate an end of a cover strip 18 (see also FIG. 4).

Figure 4:
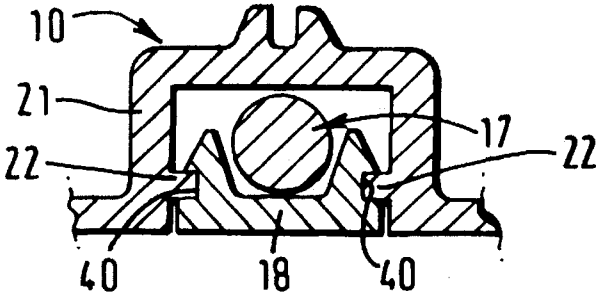
FIG. 4 is a transverse section along the line 4—4 of FIG. 1, to an enlarged scale.

At the corner of the sash 10, an L-shaped guide member 19 having a circular aperture 20 therein for guiding the free end of the locking pin 17 is secured to the sash 10 by screws 190. It should be realised, however, that by suitably modifying the member 19 by providing longitudinal grooves in each side face of each arm thereof, the screws 190 could be dispensed,with and the member 19 could then form a snap fit into the rebates 21 of the sash by engaging with the ribs 22. As can be seen from FIG. 1, the cover strip 18 is located between an end face of the guide member 19 and the axial linking rod 16, and the rebate 4 is provided to accommodate adjustments in the combined length of rod 16 and pin 17. As can be seen in FIG. 4, cover strip 18 is channel-shaped to accommodate the locking pin 17 and is provided with longitudinal recesses 40 for the snap-in engagement of the projecting ribs 22 provided in rebate of sash In use, the looking pin 17 is snapped into axial linking rod 16 to provide an espagnolette drive rod of the required length for the particular sash, and this is then snapped into rebate 21 of the sash 10. Several different predetermined lengths of linking rod 16 can be provided, and length adjustment of the entire assembly is possible by selection of an appropriate length of linking rod 16 and then assembling it as desired with the locking pin 17. By providing a screw thread engagement between rod 16 and pin 17, finer adjustment can take place by rotation of pin 17 within the rod 16. Coverstrip 18 is then snapped into place between linking rod 16 and guide member 19 (which can also be snap fitted to the corner of sash 10).

Instead of providing a plurality of different lengths of linking rod 16, and a fixed length locking pin 17, a fixed length linking rod may be provided, and a plurality of different lengths of looking pin may be provided. In this alternative, different lengths of cover strip would also be needed.

Figure 6:
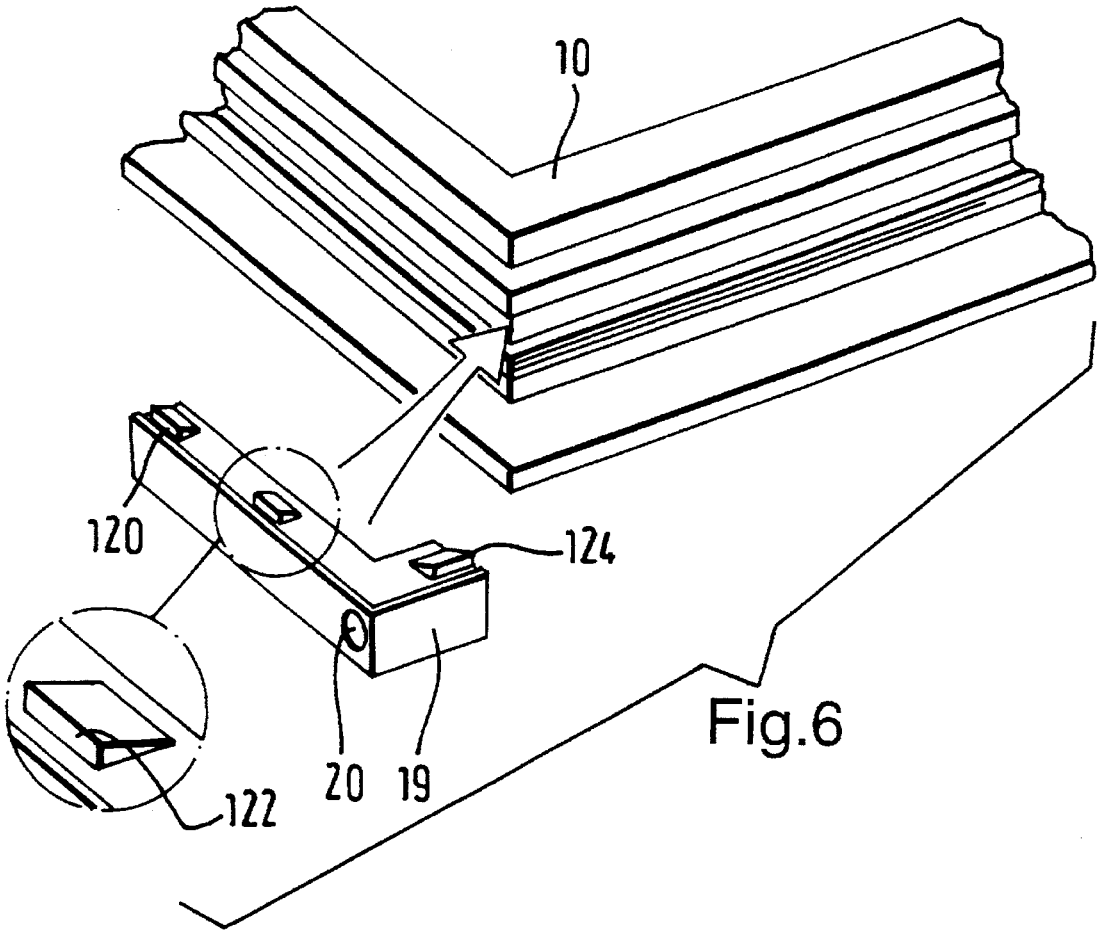
FIG. 6 is a perspective view with two details broken out showing an end guide snap fit fixture in accordance with the invention.

Operation of the espagnolette mechanism is in the standard manner using the handle to move the mushroom head 31 into engagement with the cavity 32 of the keep member 33 and to cause longitudinal movement of linking rod 16 via drive device 15. Linking rod 16 slides within the rebate 21 and relative to coverstrip 18, and the locking pin 17 which is engaged within toughened portion 51 of the groove 50 therefore also slides along a path defined by aperture 20 of guide member 19 which is located at the corner edge of the sash 10. As shown in FIG. 6, the corner guide member 19 may include connecting means 120, 122 and 124 that form a snap fit with connecting means provided on a respective end of the frame member of the sash 10. The connecting means per se are conventional, and form no particular part of the invention, except in combination with the other elements thereof. Engagement of locking pin 17 into a complementary recess provided in frame 8 enables sash 10 to be secured in relation thereto, thus providing a shoot-bolt mechanism in addition to the latching mechanism provided by roller cam 12.

It will thus be appreciated that the present invention provides am espagnolette bolt construction or drive rod arrangement, the length of which can he adjusted quickly and easily by selecting a component from a range of different lengths of component, and assembling it with a fixed length further component. The method of assembly is very quick, due to the snap together arrangement. Furthermore, the invention also provides an espagnolette bolt construction or drive rod arrangement which can be quickly and easily assembled with a snap fit into an edge of a sash.

It will of course be understood that the present invention ham been described above purely by way of example, and modifications of detail can be made within the scope of the invention.

What we claim is:

1. A combination of a sash for use in a window or door and an espagnolette locking system, the sash comprising interconnected sash frame members defining a rectangular sash frame, said sash frame having means thereon to locate at least one glazing sheet, a rebate formed in a face of at least one of the frame members of said sash frame, the espagnolette locking system mounted on said sash frame and including two bolt constructions located in respective portions of said rebate, each of said bolt constructions being connected to an operating handle forming part of said espagnolette locking system and each bolt construction being axially adjustable in length so as to allow two bolt constructions to be located in said rebates regardless of the dimensions of said sash and hence the length of said rebates, each bolt construction comprising a linking rod having a snap fit coupler and a locking pin adapted to engage the snap fit coupler in any one of a plurality of different lengths, so that the length of each interconnected rod and locking pin can be selected to fit within said rebate.

2. The combination according to claim 1, wherein the snap fit coupler comprises a groove of part circular cross-section formed in the linking rod, one end of the groove being adapted to receive one end of the locking pin.

3. The combination according to claim 1, wherein said locking pin has a roughened end portion and the snap fit coupler has a complementary roughened end portion thereby permitting the axialadjustment thereof with respect to said linking rod.

4. The combination according to claim 3, wherein the roughened portion of the snap fit coupler and/or of the locking pin is provided by a screw thread to permit fine length adjustment of the bolt construction by rotation of the pin and or the rod about its longitudinal axis.

5. The combination according to claim 1, wherein said locking pin is of a fixed standard length and said linking rod is of a length selected according to the dimensions of said sash.

6. The combination according to claim 1, wherein said linking rod is of a fixed standard length and said locking pin is of a length selected according to the dimensions of said sash.

7. The combination according to claim 1, wherein the linking rod is formed with tapered side walls each terminating in a longitudinal groove, and wherein ribs are provided in said rebate, which ribs engage in said grooves with a snap fit when said assembled linking rod is pushed into said rebate.

8. The combination according to claim 1 and further comprising two corner guide members, one located at each end of said at least one frame member, each said guide member including an aperture therein in line with said rebate and within which an end of one of said locking pins remote from its linking rod is located to facilitate the alignment of the locking pin during operation of the espagnolette locking system, each said locking pin being movable by operation of said operating handle between a first position in which it is located wholly within said aperture and a second position in which it projects beyond an open end of said aperture for engagement in a keep in a frame for said sash.

9. The combination according to claim 8 wherein each corner guide member has connecting means thereon by means of which said guide member forms a snap fit with connecting means provided on a respective end of the said at least one frame member of said sash.

10. A combination of a sash for use as a window or door and an espagnolette locking system, the sash comprising a plurality of frame members interconnected with each other to define a rectangular sash frame, means on said frame members to locate one or more sheets of glazing material for said sash, the espagnolette locking system mounted within one of said frame members, said one frame member having means thereon to locate an operating handle for said espagnolette locking system, and a rebate in a face thereon to receive two espagnolette bolts, two espagnolette bolts located within said rebate and means connecting one end of each bolt to said operating handle, said rebate being provided with means thereon for engagement with said bolts, and complementary means on said bolts for engagement with the means of said rebate whereby the bolts are engageable within said rebate with a snap fit.

11. The combination according to claim 10 wherein the means on said rebate comprise ribs projecting from opposed side walls of the rebate and the complementary means on said bolts comprise grooves within which said ribs form a snap fitting engagement.

12. The combination according to claim 10 wherein each said bolt is adjustable in length.

13. The combination according to claim 12 wherein each bolt is formed of two parts, one part forming a snap fit with the other part.

14. The combination according to claim 13 wherein a corner guide member is provided at each end of said one frame member, each corner guide member having an aperture therein in line with said rebate and in which an end of a respective bolt is slidingly engaged.

* * * * *